US008574027B2

(12) United States Patent
Kipnes

(10) Patent No.: US 8,574,027 B2
(45) Date of Patent: Nov. 5, 2013

(54) CLOTHING ARTICLE WITH AN INTEGRATED BODY SUPPORT

(75) Inventor: Deanna H. Kipnes, Marlboro, NJ (US)

(73) Assignee: Tres Chicas, LLC, Marlboro, NJ (US)

( * ) Notice: Subject to any disclaimer, the term of this patent is extended or adjusted under 35 U.S.C. 154(b) by 1018 days.

(21) Appl. No.: 12/218,606

(22) Filed: Jul. 16, 2008

(65) Prior Publication Data

US 2010/0011481 A1 Jan. 21, 2010

(51) Int. Cl.
*A41C 3/08* (2006.01)

(52) U.S. Cl.
USPC ..... 450/31; 450/30; 2/73

(58) Field of Classification Search
USPC ..... 450/7–11, 30–33, 12–29, 70; 2/73, 75, 2/105–107, 109–115, 69, 67
See application file for complete search history.

(56) References Cited

U.S. PATENT DOCUMENTS

| | | | |
|---|---|---|---|
| 357,068 | A | 2/1887 | Dalby |
| 570,696 | A | 11/1896 | Brown |
| 933,739 | A | 9/1909 | Bodensiek |
| 1,110,749 | A | 9/1914 | De Blieux |
| 1,249,446 | A | 12/1917 | Well |
| 1,774,613 | A | 9/1930 | Pidgeon |
| 1,777,215 | A | 9/1930 | McGill |
| 1,813,043 | A | 7/1931 | Foreman |
| 1,886,049 | A | 11/1932 | Rothblum |
| 1,931,822 | A | 10/1933 | Hoffman |
| D91,329 | S | 1/1934 | Redman |
| 1,977,329 | A | 10/1934 | Tobin |
| 2,033,456 | A | 3/1936 | Cunningham |
| 2,040,058 | A | 5/1936 | Mendel et al. |
| 2,052,935 | A | 9/1936 | Moran |
| 2,076,748 | A | 4/1937 | Schweig |
| 2,097,777 | A | 11/1937 | Rothman |
| D110,662 | S | 7/1938 | Rielly |
| 2,190,030 | A | 2/1940 | Kops |
| D128,536 | S | 7/1941 | Weil |
| D129,894 | S | 10/1941 | Abeles |
| 2,274,382 | A | 2/1942 | Richman |

(Continued)

FOREIGN PATENT DOCUMENTS

| | | | |
|---|---|---|---|
| DE | G 85 13 103.2 | U1 | 8/1985 |
| DE | 20 2005 000 716 | U1 | 3/2005 |

(Continued)

OTHER PUBLICATIONS

Vogue Magazine, Apr. 15, 1960, bathing suit.

(Continued)

*Primary Examiner* — Gloria Hale
(74) *Attorney, Agent, or Firm* — Watov & Kipnes, P.C.

(57) ABSTRACT

A clothing article with an integrated body support for molding and shaping the wearer's torso, includes a tubular outer garment having a free bottom end, wherein the tubular outer garment comprises an upper section adapted for supporting the bust of the wearer, and a lower section extending from the upper section for covering at least the lower torso of the wearer. The clothing article further includes a tubular inner body support extending substantially concealed in a concentric relationship with and peripherally attached to the interior portion of the outer garment, wherein the inner body support is composed of a resilient form-fitting fabric for imparting compressive support to mold and shape the lower torso and abdominal areas of the wearer.

17 Claims, 8 Drawing Sheets

(56) References Cited

U.S. PATENT DOCUMENTS

| | | | | |
|---|---|---|---|---|
| 2,310,103 | A | 2/1943 | McDonald | |
| 2,335,751 | A | 11/1943 | Friedman | |
| 2,579,547 | A | 12/1951 | Cadous | |
| 2,641,763 | A * | 6/1953 | Schroeder | 450/54 |
| D170,694 | S | 10/1953 | Kahn | |
| D174,038 | S | 2/1955 | Goldstein | |
| D174,114 | S | 3/1955 | Dior | |
| D174,115 | S | 3/1955 | Dior | |
| D174,194 | S | 3/1955 | Prochaska | |
| D177,982 | S | 6/1956 | Kahn | |
| 2,963,022 | A | 12/1960 | Spetalnik | |
| D191,347 | S | 9/1961 | Herman | |
| 3,026,875 | A | 3/1962 | Kaupp | |
| 3,036,574 | A | 5/1962 | Jeffrey | |
| 3,060,446 | A | 10/1962 | Horne | |
| 3,066,675 | A | 12/1962 | Herman | |
| D211,231 | S | 6/1968 | Saliysy | |
| 3,421,513 | A | 1/1969 | Landau | |
| 3,422,818 | A | 1/1969 | Erteszek | |
| 3,454,013 | A | 7/1969 | Cahill | |
| 3,479,844 | A | 11/1969 | Silvain | |
| 3,556,106 | A | 1/1971 | Rosner | |
| 3,699,590 | A | 10/1972 | Webber et al. | |
| D234,649 | S | 4/1975 | Lo Cascio | |
| D239,475 | S | 4/1976 | Lo Cascio | |
| 3,949,426 | A | 4/1976 | George | |
| 4,372,320 | A | 2/1983 | Silber | |
| 4,916,755 | A | 4/1990 | Feigenbaum et al. | |
| 4,976,653 | A | 12/1990 | White | |
| 5,083,316 | A | 1/1992 | Kuehner | |
| 5,094,648 | A | 3/1992 | Turner | |
| 5,566,392 | A | 10/1996 | Dzelzkalns | |
| 5,605,060 | A | 2/1997 | Osborne | |
| D391,740 | S | 3/1998 | Barrington et al. | |
| 5,915,531 | A * | 6/1999 | Hilpert et al. | 2/69 |
| 5,996,120 | A * | 12/1999 | Balit | 2/67 |
| 6,000,993 | A | 12/1999 | Erwin | |
| 6,035,439 | A * | 3/2000 | Chin | 2/67 |
| 6,061,832 | A * | 5/2000 | Morrison, Jr. | 2/78.1 |
| 6,185,741 | B1 | 2/2001 | Kehoe | |
| D452,600 | S | 1/2002 | Kim | |
| D453,058 | S | 1/2002 | Kim | |
| D453,255 | S | 2/2002 | Kim | |
| 6,430,748 | B1 | 8/2002 | Burkhart | |
| 6,443,805 | B1 * | 9/2002 | Kirkwood | 450/31 |
| D476,464 | S | 7/2003 | Jenkins | |
| 6,846,217 | B1 | 1/2005 | Struble et al. | |
| 7,083,494 | B2 | 8/2006 | Sandroussi et al. | |
| D556,978 | S | 12/2007 | Thunstedt | |
| 7,340,780 | B2 | 3/2008 | Levy | |
| 7,395,557 | B1 * | 7/2008 | Ledyard | 2/113 |
| D595,480 | S | 7/2009 | Giugliano | |
| 7,814,569 | B2 * | 10/2010 | Di Lorenzo | 2/67 |
| 8,185,970 | B2 | 5/2012 | Summers et al. | |
| 2007/0094765 | A1 * | 5/2007 | Summers et al. | 2/113 |
| 2008/0078208 | A1 | 4/2008 | Kronbach | |
| 2008/0134409 | A1 * | 6/2008 | Karasina | 2/117 |
| 2008/0244805 | A1 * | 10/2008 | Griffin | 2/74 |
| 2008/0256676 | A1 * | 10/2008 | Di Lorenzo | 2/67 |

FOREIGN PATENT DOCUMENTS

| | | | |
|---|---|---|---|
| EM | 3855620-0106 | A1 | 1/2005 |
| EM | 454202-0027 | A1 | 2/2006 |
| EM | 454202-0121 | A1 | 2/2006 |
| EM | 633755-0027 | A1 | 1/2007 |
| EM | 730403-0023 | A1 | 10/2007 |
| GB | 116526 | A | 6/1918 |
| GB | 212307 | A | 3/1924 |
| GB | 1 603 600 | A | 11/1981 |
| GB | D3020687 | | 7/2005 |
| GB | D4004524 | | 10/2007 |
| JP | 2-82707 | U | 6/1990 |
| JP | 2001-172806 | A | 6/2001 |
| JP | 2002-138302 | A | 5/2002 |
| JP | 2003-129303 | A | 5/2003 |
| JP | 2005-281893 | A | 10/2005 |
| JP | 2006-316359 | A | 11/2006 |
| JP | 2007-146337 | A | 6/2007 |
| JP | 2007-303002 | A | 11/2007 |
| JP | 2008-156812 | A | 7/2008 |

OTHER PUBLICATIONS

Target ad in Self Magazine, Jun. 2007, for Champion tanks.
Self Magazine, Jun. 2000, second row third bathing suit.
Self Magazine, Jan. 2006, featuring Nike.
Self Magazine, Dec. 2007, pink Nike tank.
Self Magazine, Apr. 2002, Puma Tank (bottom corner).
Lucky Magazine, Oct. 2006, Pink Eberjey Cami.
Lucky Magazine, Oct. 2003, Serena's tank.
Lucky Magazine, Jan. 2002, Lace Trimmed Chemise.
JC Penney Catalog, 2002-2003.
JC Penney Catalog, 2006, Bellybra.
File History for U.S. Appl. No. 11/478,247 (corresponds to Publication No. US 2007/0094765 A1).

* cited by examiner

CLOTHING ARTICLE WITH AN INTEGRATED BODY SUPPORT

FIELD OF THE INVENTION

The present invention relates generally to articles of clothing, and more particularly to a clothing article with an integrated body support for molding and shaping the wearer's torso.

BACKGROUND OF THE INVENTION

Articles of clothing or tops including tank tops, t-shirts, halter tops, camisoles, and other garments that substantially cover the upper body, are frequently worn as outerwear, especially during warmer weather. The top may be worn loose or tight around the bust or waist, and may have sleeves or shoulder straps, or may be strapless. The top may be worn with the bottom hem tucked underneath the wearer's pants, shorts or skirts, or hanging loosely. It is typically desirable for women to wear tops without a brassiere for further comfort and casual convenience. Such garments are constructed with extra bust support in the form of an interior brassiere such as a shelf brassiere or a true built-in brassiere.

As mentioned, such tops are generally intended to be worn loosely, or close-fitted to the torso. Unfortunately, the tops also provide little or no support to mold and shape the torso into a desired shape that is flattering to the wearer. Corsets are typically used for accentuating a curvy figure, by reducing the waist and thereby exaggerating the bust and hips in women, or emphasizing a slimmer appearance in men. While corsets provided slimming impressions and silhouettes to the torso, the lacing, and stiffening members such as boning, ribs or stays, limited their use due to their bulk and the need to be custom fitted for each individual.

Accordingly, there is a need for a clothing article provided with an integrated body support for molding and shaping the wearer's torso without uncomfortable boning, ribs or stays and without lacing. There is a further need for a clothing article, which includes a body support that is compact, snug and inconspicuous. There is a further need for a clothing article that enhances the shape of the torso, particularly the waistline, to achieve a flattering natural appearance, while remaining comfortable and convenient to dress and wear.

SUMMARY OF THE INVENTION

The present invention relates generally to a clothing article with an integrated body support for molding and shaping the wearer's torso. The clothing article of the present invention is configured to at least cover the torso, and includes an outer garment for styling and design, and an inner body support extending from the interior portion of the outer garment. The outer garment may comprise a stretchable fabric. The inner body support is adapted for effectively molding and shaping the lower torso and abdomen of the wearer without the use of boning, ribs or stays and without lacing. The combination of the inner body support and outer garment provides an entirely smooth natural and uniform appearance to the wearer's lower torso and abdominal areas, while remaining comfortable during active wear. Preferably, the outer garment is a camisole.

In this manner, the clothing article of the present invention is specifically designed to discreetly minimize or eliminate the presence of unflattering bulges in the lower torso and abdominal areas without sacrificing comfort and ease of wear, and remaining simple and cost effective to make and use. Furthermore, the clothing article of the present invention is easy to maintain and does not require special care for washing and storage. Optionally, the clothing article of the present invention may further include an interior brassiere to accommodate and support the wearer's bust, thus precluding the need to wear a separate brassiere and further enhancing comfort and convenience.

In one aspect of the present invention, there is provided a clothing article with an integrated body support for molding and shaping the wearer's torso, comprising:

an outer garment adapted for substantially covering the wearer's torso; and a tubular inner body support extending substantially concealed in a concentric relationship with and peripherally attached to the interior portion of the outer garment, said inner body support being adapted for imparting compressive support to mold and shape the lower torso and abdominal areas of the wearer.

In another aspect of the present invention, there is provided a clothing article with an integrated body support for molding and shaping the wearer's torso, comprising:

a tubular outer garment having a free bottom end, said tubular garment comprising an upper section adapted for supporting the bust of the wearer, and a lower section extending from the upper section for covering at least the lower torso of the wearer; and a tubular inner body support extending substantially concealed in a concentric relationship with and peripherally attached to the interior portion of the outer garment, the inner body support being composed of a resilient form-fitting fabric for imparting compressive support to mold and shape the lower torso and abdominal areas of the wearer.

BRIEF DESCRIPTION OF THE DRAWINGS

The following drawings are illustrative of embodiments of the present invention and are not intended to limit the invention as encompassed by the claims forming part of the application.

DETAILED DESCRIPTION OF THE INVENTION

Figure 1:
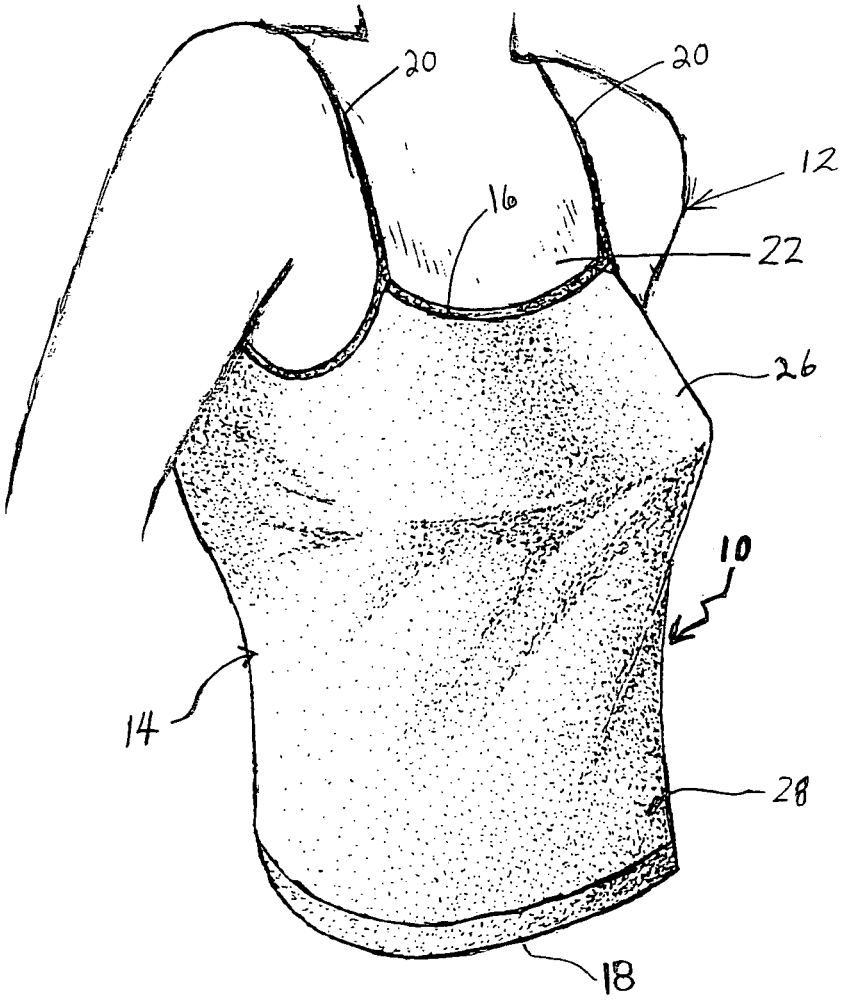
FIG. 1 is a perspective view of a clothing article in accordance with one embodiment of the present invention.

The present invention is directed to a clothing article with an integrated body support for molding and shaping the wearer's torso. The clothing article of the present invention is configured to at least substantially cover the torso, and includes an outer garment for styling and design, and an inner body support extending from the interior portion of the outer garment. The outer garment may comprise a stretchable fabric. The inner body support is adapted for effectively molding and shaping the lower torso and abdomen of the wearer without the use of boning, ribs or stays and without lacing. While the inner body support may be used in any suitable outer garment, the present invention will be disclosed in the context of a garment known as a camisole. The combination of the inner body support and outer garment provides an entirely smooth natural and uniform appearance to the wearer's lower torso and abdominal areas, while remaining comfortable during active wear.

In this manner, the clothing article of the present invention is specifically designed to discreetly minimize or eliminate the presence of unflattering bulges in the lower torso and abdominal areas without sacrificing comfort and ease of wear, and remaining simple and cost effective to make and use. Furthermore, the clothing article of the present invention is easy to maintain and does not require special care for washing and storage. Optionally, the clothing article of the present invention may further include an interior brassiere to accommodate and support the wearer's bust, thus precluding the need to wear a separate brassiere and further enhancing comfort and convenience.

In one embodiment of the present invention, there is provided a clothing article with an integrated body support for molding and shaping the wearer's torso, comprising an outer garment adapted for substantially covering the wearer's torso, and a tubular inner body support extending substantially concealed in a concentric relationship with and peripherally attached to the interior portion of the outer garment, wherein the inner body support is adapted for imparting compressive support to mold and shape the lower torso and abdominal areas of the wearer. Preferably, the outer garment is in the form of a camisole. In view of the integration of the body support construction with the camisole, adjustable straps may be incorporated into the camisole, e.g., shoulder straps, that will further enhance the fit of the garment and body support combination.

As used herein, the term "top" refers to garments that at least substantially covers or conceals the upper human body or torso, and includes a bottom hem at one end, and a neckline at the other end that may terminate into a head-covering hood. The top can vary in length from the head or chest area to at least abdominal area or mid-thigh, and may be worn loosely or close-fitted. Examples of a top include camisoles, halter tops, shirts, tank tops, long-sleeved and t-shirts, polo shirts, golf shirts, and sports jerseys.

As used herein, the term "camisole" refers to a particular form of women's top, which can be worn as an outerwear covering at least the upper part of the human body or the torso area, and which may be sleeveless and close fitted. The camisole may include a built-in brassiere to provide appropriate bust support, thereby foregoing the need to wear a separate brassiere.

As used herein, the term "torso" refers to a central portion of the human body from which extends the neck and limbs, and comprises the upper torso or thorax including the chest area, and lower torso or abdomen.

As used herein, the terms "brassiere" or "bra" refer to a structure that covers, supports, and elevates the bust of the wearer. Examples of a brassiere include shelf bras, gel bras, sport bras, and the like.

Figure 2:
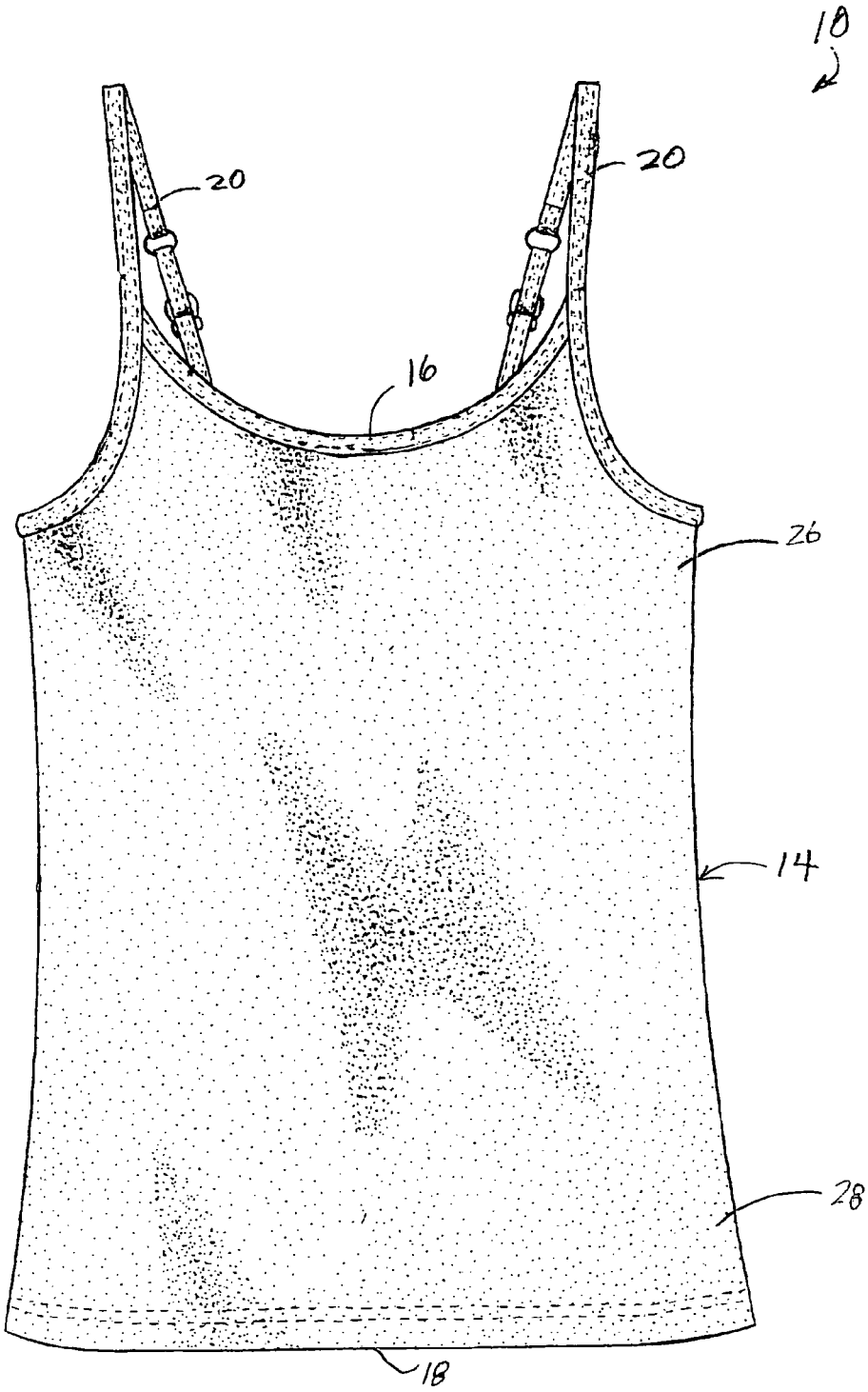
FIG. 2 is a front elevational view of the clothing article of FIG. 1 in accordance with the present invention.
Figure 3:
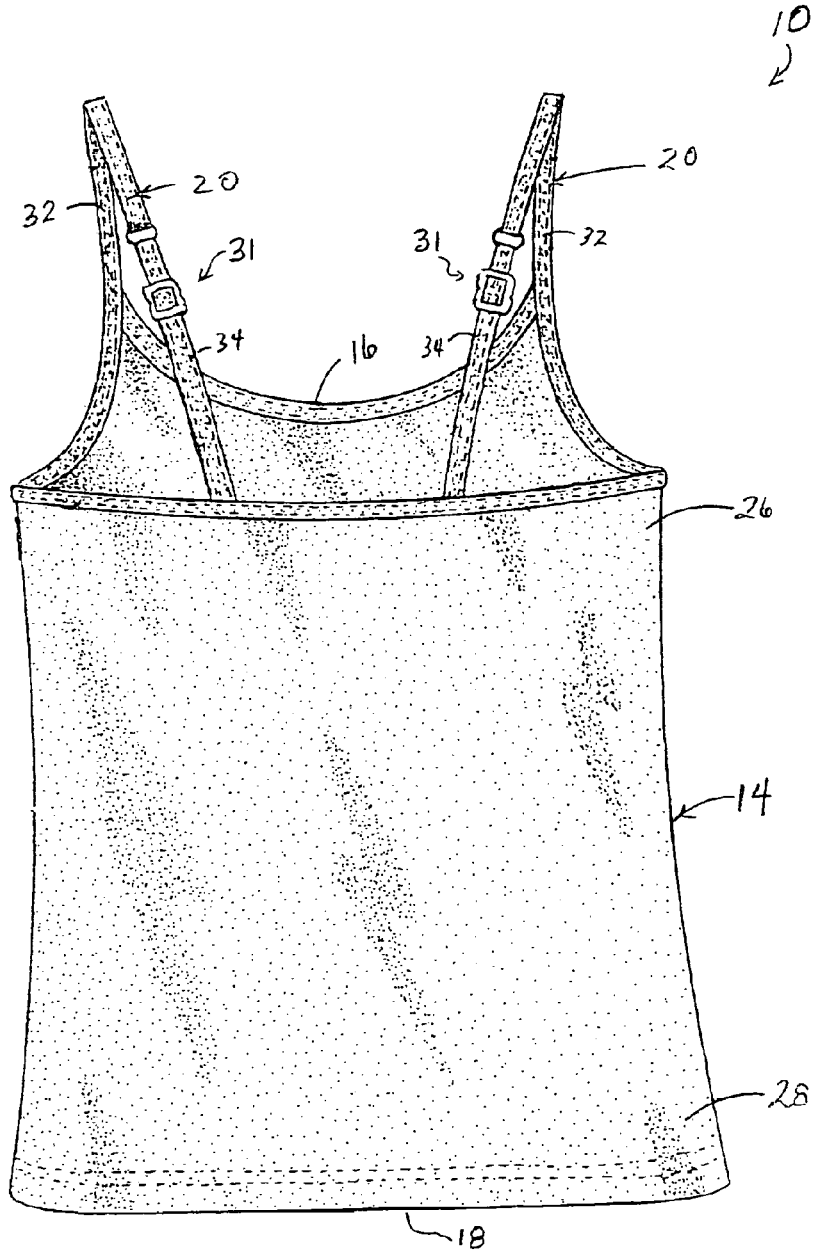
FIG. 3 is a rear elevational view of the clothing article of FIG. 1 in accordance with the present invention.
Figure 4:
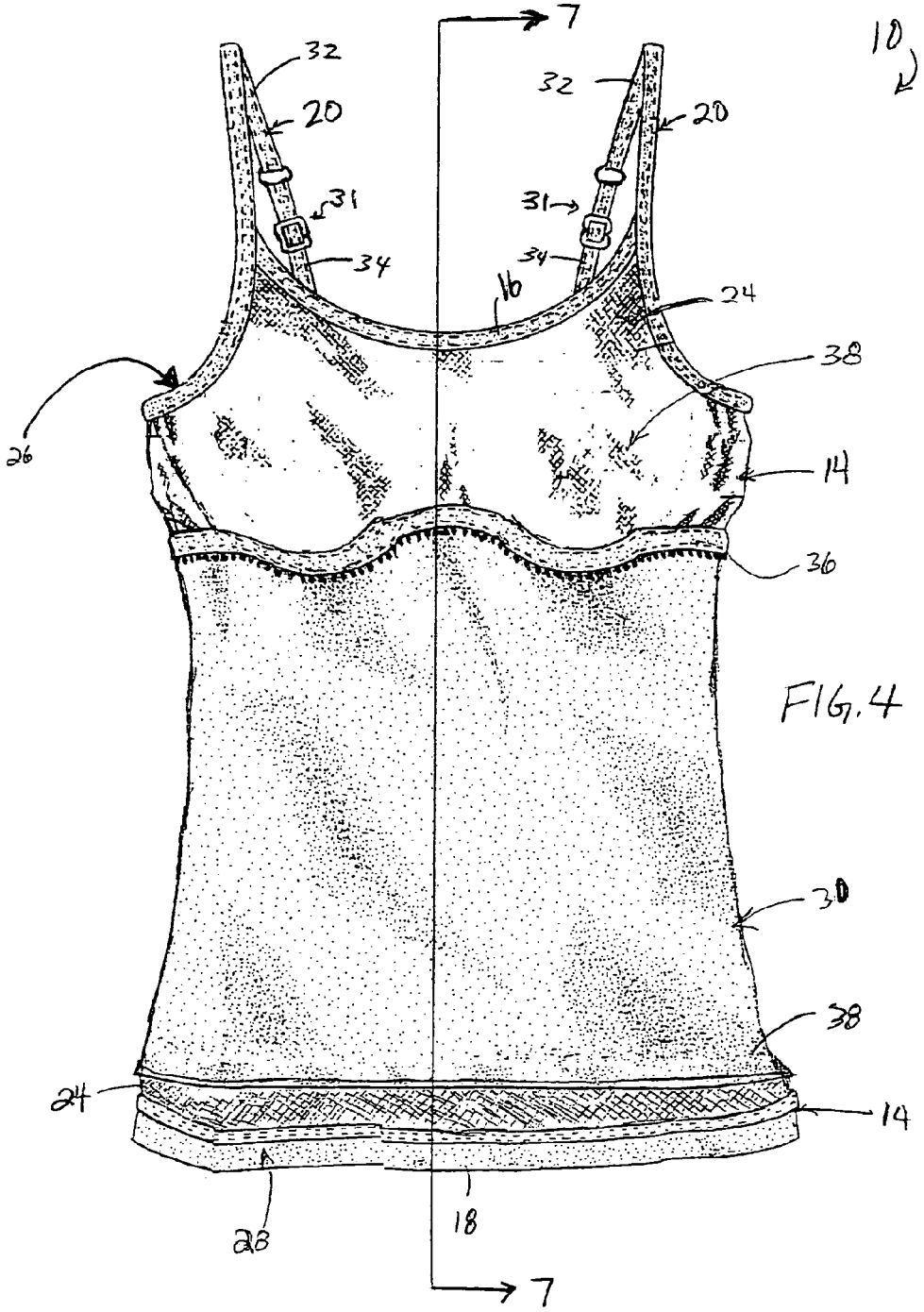
FIG. 4 is a front elevational view of the clothing article inverted inside-out to show the structure of an inner support lining in accordance with the present invention.
Figure 5:
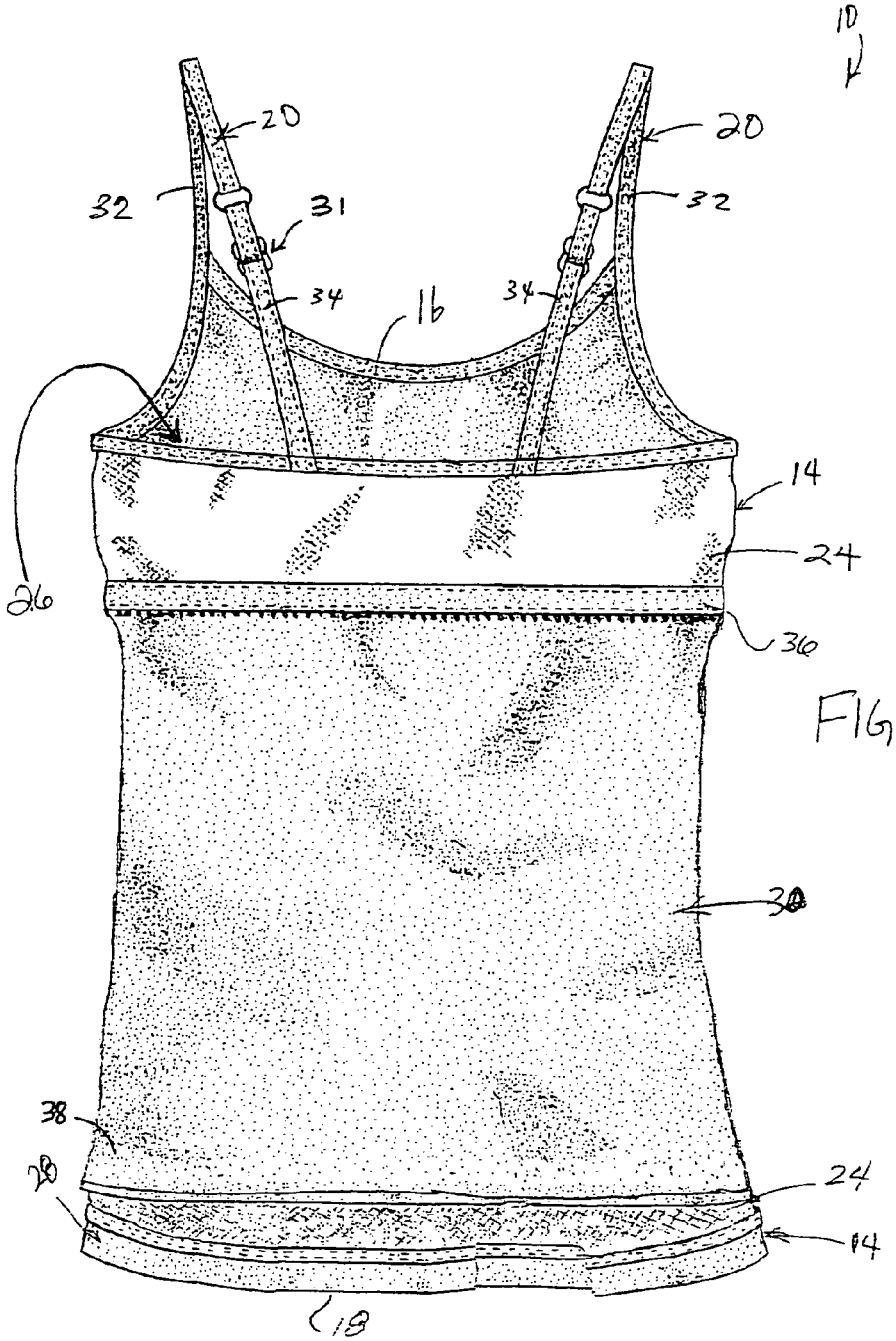
FIG. 5 is a rear elevation elevational view of the clothing article of FIG. 4 in accordance with the present invention.

Referring to FIGS. 1-3, a clothing article identified generally by reference numeral 10 is shown worn by a wearer 12 for one embodiment of the present invention. The clothing article 10 includes a tubular outer garment 14 in the form of a top or camisole having a neckline portion 16, a bottom hem portion 18 and a pair of adjustable straps 20 for suspending the outer garment 14 about a torso 22 of the wearer 12. The clothing article 10 further includes a tubular inner body support 30 (as shown in FIGS. 4 and 5) extending substantially concealed in a concentric relationship with and peripherally attached to the interior portion of the outer garment 14, whereby the inner body support 30 is adapted for imparting compressive support to mold and shape the lower torso and abdominal areas of the wearer 12 as will be further described hereinafter.

The outer garment 14 is fabricated to provide styling and design and to substantially cover the wearer's torso 22, and includes an upper section 26 adapted for supporting the bust of the wearer 12, and a lower section 28 extending from the upper section 26 for covering at least the lower torso of the wearer 12. Those skilled in the art will further recognize that various decorative flares (not shown) may be added to the clothing article 10 or to its various components without departing from the scope of the invention. The outer garment 14 may comprise a lightweight material including knit, woven or non-woven fabrics such as, for example, satin, silk, cotton, and the like, and more preferably, a stretchable fabric material. The tubular outer garment 14 may further include a mesh liner or reinforced backing 24 secured along substantially an inside portion thereof (as shown in FIGS. 4 and 5). The mesh liner 24 provides lateral rigidity to the outer garment 14 to prevent or minimize overstretching of the fabric material as will be described hereinafter.

As noted previously, the upper section 26 may be constructed to support and elevates the bust of the wearer. This may be accomplished by adapting the upper section 26 of the outer garment 14 to generate an interior brassiere such as a shelf bra into the interior portion of the outer garment 14. The clothing article 10 provides sufficient bust support to relieve the need to wear a separate brassiere.

With specific reference to FIG. 3, the adjustable straps 20 further include adjustable buckles 31 that frictionally engage free end portions of front and rear strap segments 32 and 34. The configurations of the adjustable straps 22 including variations thereof are apparent to those of ordinary skill in the art.

Referring to FIGS. 4 and 5, the clothing article 10 is shown with the interior portion turned out to show the construction of the tubular inner body support 30 and an integrated or interior brassiere 38 within the outer garment 14. The integrated brassiere 38 is formed from the combination of the mesh liner 24 and the upper section 26 of the outer garment to provide an area with natural shaping, whereby the wearer's breasts are comfortably retained. The slight degree of concavity increases the surface area over which the weight of each breast is distributed. The mesh liner 24 further extends down to the bottom hem portion 18 of the outer garment 14 to provide lateral rigidity to the lower section 28, thus preventing or minimizing overstretching.

The tubular inner body support 30 is configured to encircle the wearer's torso and provide a body-snug fit and support. The tubular inner body support 30 is attached at the interior lower end of the upper section 26 of the outer garment 14 along a seam portion 36 extending therealong, and remains concealed by the outer garment 14. The tubular inner body support 30 is constructed of an elasticized or resilient form-fitting material for imparting compressive support to mold and shape the lower torso and abdominal areas of the wearer 12, while permitting relatively free and unencumbered movement of the wearer 12. The tubular inner body support 30 includes a lower end 38 extending therealong. The lower end 38 of the support 30 remains free and unattached from the bottom hem portion 18 and the lower section 28 of the outer garment 14. This imparts a natural shape and appearance to the lower torso and abdominal areas of the wearer 12.

The resilient form-fitting material can be selected from suitable materials including, for example, spandex, darlex, nylon, cotton, polyurethane, neoprene, elastomer and the like. Preferably, the resilient form-fitting material is a fabric to permit passage of moisture and air therethrough. The elastomer may be selected from saturated and unsaturated rubbers.

Examples of unsaturated rubbers include natural rubber, synthetic polyisoprene, butyl rubber (copolymer of isobutylene and isoprene) such as halogenated butyl rubbers (e.g., chloro-butyl rubber or bromo-butyl rubber), polybutadiene, styrene butadiene rubber, nitrile rubber (copolymer of polybutadiene and acrylonitrile) such as hydrogenated nitrile rubber, and chloropene rubber such as polychloroprene.

Example of saturated rubbers include ethylene propylene rubber (copolymer of ethylene and propylene), ethylene propylene diene rubber, epichlorohydrin rubber, polyacrylic rubber, silicone rubber, fluorosilicone rubber, fluoroelastomers, perfluoroelastomers, polyether block amides, chlorosulfonated polyethylene, and ethylene vinyl acetate.

Figure 7:
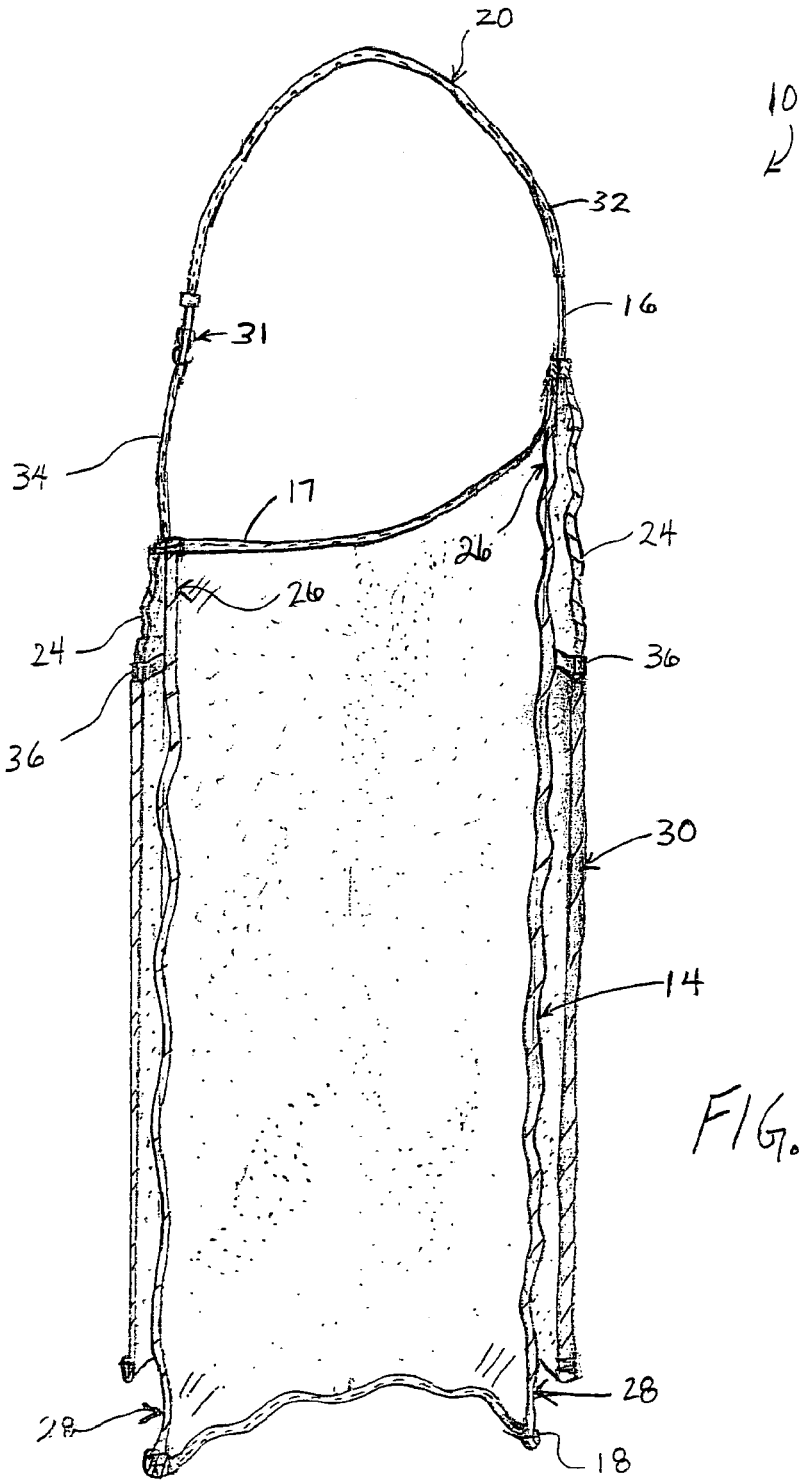
FIG. 7 is a side cross sectional view of the clothing article taken along cross-section line 7-7 of FIG. 4 in accordance with the present invention.

Referring to FIG. 7, a side cross section of the clothing article 10 is shown. The inner body support 30 is securely sewn to the lower end of the mesh liner 24 of the outer garment 14 along the seam portion 36. The mesh liner 24 is securely sewn to the upper section 26 of the outer garment 14 along the neckline portion 16 and edge portion 17 thereof. The lower portion 28 of the outer garment 14 extends from the upper portion 26 to sufficiently cover at least the lower torso of the wearer 12.

Figure 6:
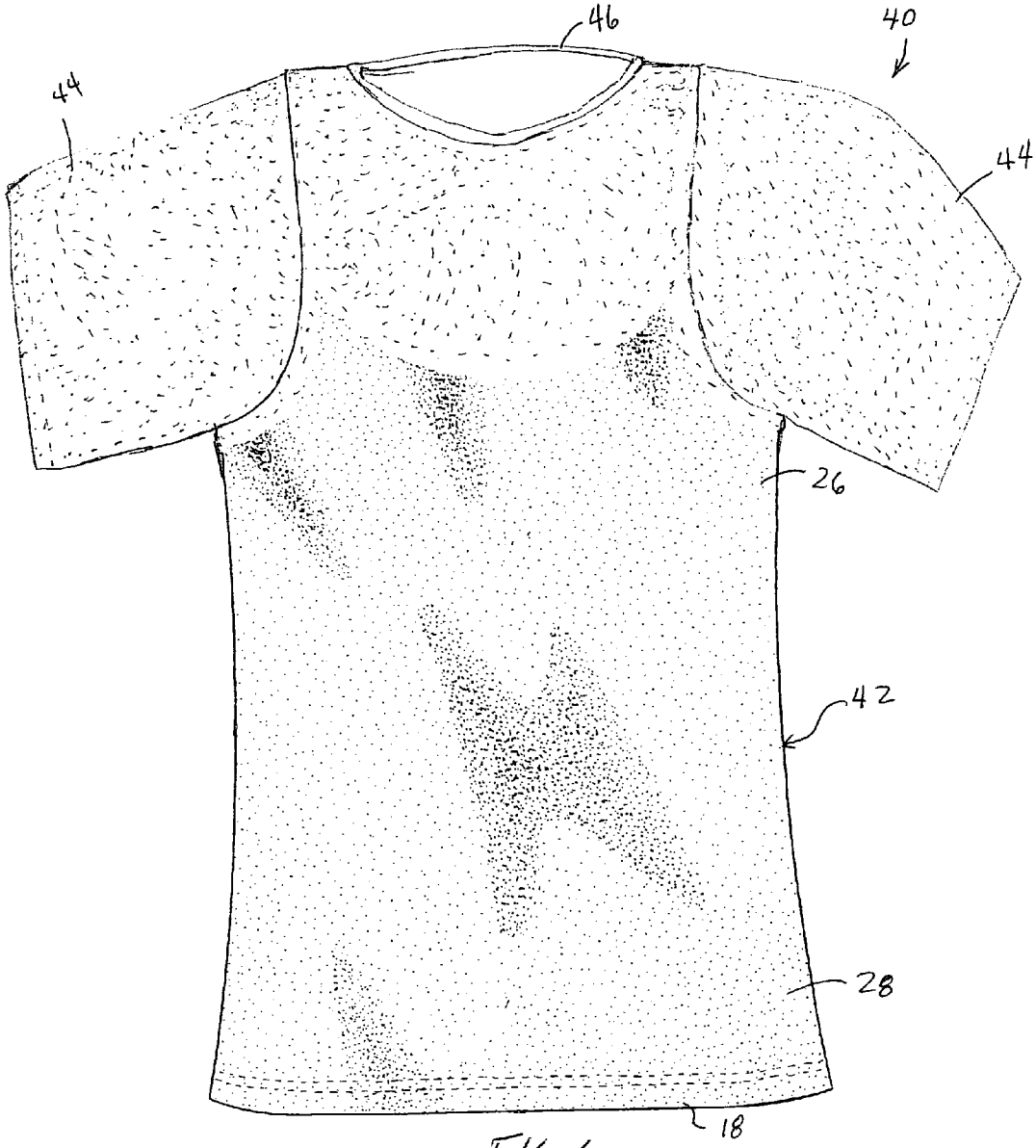
FIG. 6 is a front elevational view of a clothing article for another embodiment of the present invention.

Referring to FIG. 6, a clothing article 40 is shown for another embodiment of the present invention. The clothing article 40 is similar to the clothing article 10 of the previous embodiment except for the form of outer garment. The clothing article 40 includes an outer garment 42 in the form of a t-shirt, adapted to cover the shoulders of the wearer. The outer garment 42 includes a pair of sleeves 44 and a circular neckline 46. It will be understood that the outer garment 42 may be constructed to form many different types of clothing as desired.

Figure 8:
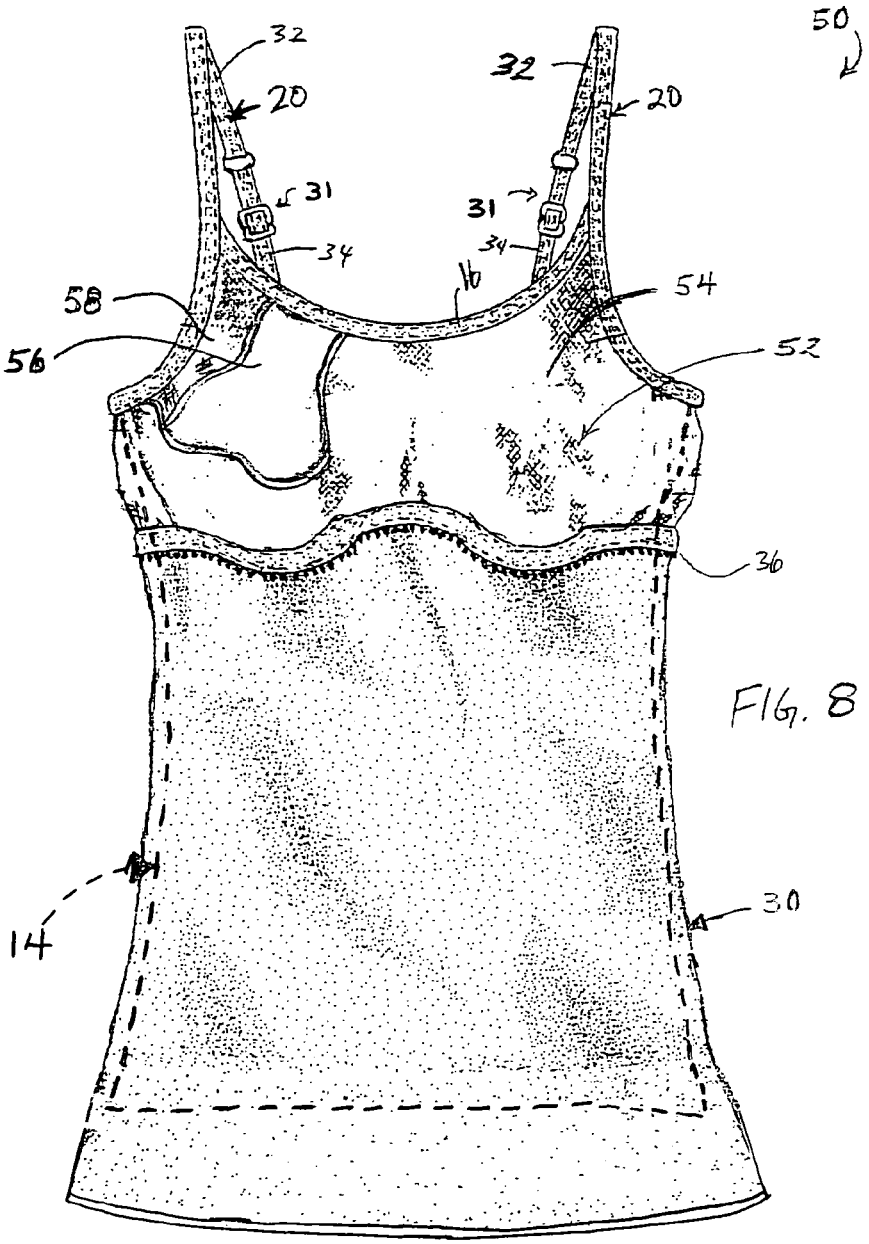
FIG. 8 is partially cutaway front elevational view of a clothing article inverted inside-out to show the structure of a gel bra constructed therein in accordance with a third embodiment of the present invention.

Referring to FIG. 8, a clothing article 50 is shown for a third embodiment of the present invention. The clothing article 50 is similar to the clothing article 10 of the first embodiment as previously described above. The clothing article 50 includes a gel bra 52 from which the inner body support 30 is securely stitched via seam portion 36. In the present embodiment of the invention, the length of the inner body support 30 extends beyond the length of the outer garment 14, thus allowing the inner body support 30 to be tucked conveniently underneath the wearer's pants. The gel bra 52 includes a first surface 54, an opposed second surface 58 and a gel layer portion 56 interposed between the first and second surfaces 54 and 58. The gel layer portion 56 is generally composed of a suitable fluid or gel material contained within an impermeable material (e.g., flexible plastic or polyvinyl chloride). The gel layer portion 56 is suitably shaped and positioned between the first and second surfaces 54 and 58 to accentuate or enhance the bust size/shape of the wearer 12.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A clothing article in the form of a top with an inner body support for molding and shaping an upper torso of a wearer, comprising:

an outer garment having an interior surface facing the wearer's upper torso and an exterior surface facing away from the wearer's upper torso, said outer garment adapted for substantially covering the wearer's upper torso and comprising an upper section with support means for placing about the wearer's shoulders to support the clothing article about the upper torso, and a lower section extending downwardly from the upper section having a first bottom end free from the inner body support and lying between the waist and the hips of the wearer;

an inner body support substantially concealed by the outer garment when the top is worn by the wearer and comprising an upper section attached to the interior surface of the outer garment and a lower section, said inner body support comprising a resilient form-fitting material at least overlaying the upper torso of the wearer to impart sufficient compressive support to mold and shape the upper torso of the wearer, and said lower section having a second bottom end lying between the waist and hips of the wearer; and an interior brassiere defined by at least the upper section of the inner body support.

2. The clothing article of claim 1, wherein the top is selected from the group consisting of camisoles, halter tops, shirts, and tank tops.

3. The clothing article of claim 1, wherein the upper section further comprises a pair of coextensive straps for extending over the shoulders of the wearer.

4. The clothing article of claim 1, wherein the upper section of the outer garment is adapted to cover the shoulders of the wearer.

5. The clothing article of claim 4, wherein the upper section of the outer garment further comprises sleeves.

6. The clothing article of claim 1, wherein the resilient form-fitting material is a fabric.

7. The clothing article of claim 1, wherein the resilient form-fitting material is selected from the group consisting of spandex, darlex, nylon, cotton, polyurethane, neoprene, elastomer and combinations thereof.

8. The clothing article of claim 7, wherein the elastomer is selected from the group consisting of saturated rubber, unsaturated rubber and combinations thereof.

9. The clothing article of claim 8, wherein the unsaturated rubber is selected from the group consisting of natural rubber, synthetic polyisoprene, butyl rubber, halogenated butyl rubbers, polybutadiene, styrene-butadiene rubber, nitrile rubber, hydrogenated nitrile rubber, chloroprene rubber, and combinations thereof.

10. The clothing article of claim 8, wherein the saturated rubber is selected from the group consisting of ethylene propylene rubber, ethylene propylene diene rubber, epichlorohydrin rubber, polyacrylic rubber, silicone rubber, fluorosilicone rubber, fluoroelastomers, perfluoroelastomers, polyether block amides, chlorosulfonated polyethylene, ethylene vinyl acetate and combinations thereof.

11. The clothing article of claim 1 wherein the upper section of the outer garment comprises a lower end, said inner body support being connected to the lower end of the upper section of the outer garment through a seam to form said brassiere.

12. The clothing article of claim 1, worn with a second clothing article secured about the waist of a wearer, wherein the inner body support is tucked inside the second clothing article and the outer garment is worn outside the second clothing article.

13. The clothing article of claim 1 wherein the first bottom end of the outer garment extends below the second bottom end of the inner body support.

14. The clothing article of claim 1 wherein the brassiere is selected from the group consisting of a shelf bra, and a sport bra.

15. The clothing article of claim 14 wherein the brassiere is a shelf bra.

16. The clothing article of claim 1 wherein the brassiere is comprised of the combination of the upper section of the outer garment and a mesh liner.

17. The clothing article of claim 16 wherein the mesh liner extends to a bottom hem portion of the outer garment.

* * * * *